United States Patent [19]

Nokes

[11] 4,254,808

[45] Mar. 10, 1981

[54] WEDGING APPARATUS USEFUL FOR LOG SPLITTING

[76] Inventor: Ronald W. Nokes, 8150 LaPlace Ct., Westminster, Colo. 80030

[21] Appl. No.: 823,490

[22] Filed: Aug. 10, 1977

[51] Int. Cl.[2] ..... B27L 7/00

[52] U.S. Cl. ..... 144/193 C; 144/193 R; 173/102; 254/104; 299/23

[58] Field of Search ..... 144/193 R, 193 A, 193 B, 144/193 C, 193 D; 254/104; 299/23; 269/22; 173/102

[56] References Cited

U.S. PATENT DOCUMENTS

| | | | |
|---|---|---|---|
| 2,328,661 | 9/1943 | Maloney | 299/23 |
| 2,474,037 | 6/1949 | Cuthrell | 149/34 |
| 2,526,362 | 10/1950 | Johnston | 164/46 |
| 2,691,512 | 10/1954 | Arizio | 254/104 X |
| 2,783,670 | 3/1957 | Graves et al. | 144/193 C X |
| 3,050,095 | 9/1962 | Prather | 144/193 R |
| 3,377,052 | 4/1968 | Hagen | 254/104 |
| 3,409,095 | 11/1968 | Bardwell | 173/102 |
| 3,865,163 | 2/1975 | Root | 144/193 |

FOREIGN PATENT DOCUMENTS

| | | | |
|---|---|---|---|
| 48054 | 2/1964 | Poland | 144/193 B |

*Primary Examiner*—R. L. Spruill
*Assistant Examiner*—W. D. Bray
*Attorney, Agent, or Firm*—Earl C. Hancock

[57] ABSTRACT

Two elongated members are coaxially moveable relative to one another with one member rigidly attached to a working head such as an elongated wedge or the like. In one embodiment, the inner member is fixed to the working head while the outer member moveably surrounds the inner member. The outer member is dimensioned so that its lower perimeter edge is small enough to allow the members to be reciprocated so as to drive the head into a log or other material without the outer member being held against coaxial reciprocal movement by the material. The members can be secured as for lifting, withdrawing, transporting, etc., with a particularly advantageous form of the securing means being a flexible collar on the outer member for cooperating with a hole therethrough for gripping the inner member. The outer member can be fixed to the working head and the inner member reciprocally moveable therein.

6 Claims, 6 Drawing Figures

WEDGING APPARATUS USEFUL FOR LOG SPLITTING

BACKGROUND OF THE INVENTION

The present invention relates to apparatus for splitting or separating yieldable materials. More particularly, the present invention relates to apparatus for performing a wedgeing function on any material having a softer composition than the material from which the wedging apparatus is fabricated. The present invention is particularly useful for splitting logs, lumber products or the like but has other utilities that will be readily apparent from the description herein. For instance, the invention can be used for driving holes into the earth, splitting rocks, and so forth.

The problem of how to split logs and the like lengthwise has been predominantly resolved by the use of angular shaped wedges which are pounded into the log by mauls, sledge-hammers or other instruments. The task can be satisfactorily completed by use of such implements but certain hazards and difficulties are inherently encountered. For example, the top of the wedge frequently releases flakes of metal upon impact, the holding of the wedge in place for initial striking necessarily exposes the user to injury especially to the hands and arms, the head of the maul or hammer may glance from the head of the wedge or unexpectedly separate from the handle exposing the user to serious injury, etc. Furthermore, particularly with large hardwood logs, the wedge will enter the log to a point where it can no longer be struck by the maul but is securely held in that position by the log thereby requiring the use of additional wedges or some other procedure for completing the log splitting. Additionally, the wedges and hammers needed for this form of log splitting somehow seem to frequently be in widely separated locations when they are needed as anyone who has had any experience with log splitting by this procedure can attest.

One prior art solution to the myriad of problems associated with log splitting as mentioned above is through the use of hydraulic powered wedges. This solution is not attractive to the average log splitter since the device is expensive, inconvenient to transport, requires a suitable frame for holding the logs in place, and involves multiple moving parts that are subject to costly repair. Although lever actuated cutter devices such as that shown in U.S. Pat. No. 2,526,362 by Johnston may be adapted for transverse cutting of some logs, these type devices are not suitable for lengthwise log splitting especially in view of the awkwardly large log holding frame that would be needed as well as the excessively long cutter elements and lever lengths for adaption to log splitting. Even if so adapted, the Johnston type apparatus would not be convenient for easy transport by an individual user.

So-called captured hammer devices have been suggested in the prior art such as in U.S. Pat. Nos. 2,474,037 by Cuthrell and 3,050,095 by Prather. Cuthrell employs a tractor mounted trip-hammer type mechanism wherein the wedge element is positioned upon a reciprocally moveable carriage so that it can be raised by the tractor's winch and released to fall upon the object to be severed. Prather shows an elongated stem of a hexagonal cross-section with a piercing tip on one end and a large diameter weight slidable on the stem between two stops. Neither device is acceptable to the average log splitter since, in the case of Cuthrell, an unacceptably complex mechanism is required whereas for Prather, the elongated stem must be at least approximately as long or longer than the longest log that may be split. Prather further requires acceptance of exposed anvil surfaces at the stops, a hazard somewhat similarly involved in the Cuthrell device.

Another prior art attempt to overcome the difficulties of single wedge use is suggested in U.S. Pat. No. 3,865,163 by Root wherein outwardly pivotable jaws are hinged to the wedge element to spread the log sides as the wedge enters the log. However, various mechanical disadvantages render these devices unacceptable such as the difficulty in selecting a universally usable jaw length and reliability problems with long-term usage because of the stress associated with the jaw pivot points.

SUMMARY OF THE INVENTION

The present invention is an apparatus particularly well suited for performing wedging type operations such as log splitting and the like. Typically the invention includes a pair of elongated members arranged so that one such member is coaxially movable relative to the other through the agency of one member being hollow for receiving the other member. An elongated, preferably wedge shaped working head is rigidly attached to one of the coaxially reciprocable members. That is, the working head has a base and a tapered body extending from the base with one of the elongated members rigidly attached to this base so that the central axis of the attached member is generally normal to the plane of the base. Thus the coaxially moveable members can introduce impact forces directly upon or via transferal to the head as a result of the movement between the members. These impact forces drive the head into the log until it has completely passed through the log.

In one form of the invention, the outer member is moveable with the outer, lower edge thereof configured so as to be equal to or less than the dimension of the wedged opening in the log. A cap enclosing one end of the outer member can be included to provide driving impact to the inner member and, by having the outer member shorter than the inner member, a greater thickness of the outer member can be used. In another form of the invention, the outer member can be fixed to the working head base and the inner member reciprocally moveable therein.

An especially advantageous feature of the present invention resides in the means for temporarily securing the inner and outer coaxially moveable members against such movement. An exemplary form of this retainer is a flexible band around the outer surface of the outer member but with the band being deformable into one or more apertures or openings through the outer member so as to frictionally engage the inner member.

It will be recognised that this invention overcomes the inadequacies of the prior art including those enumerated above. Apparatus in accordance with the invention can be economically constructed, easily transported as a unit by a single user and is inherently safer and more efficient in use than the conventional wedge and maul or other prior art devices while avoiding the complexity and lack of reliability of the more sophisticated apparatus.

Other advantages, features, objects and variations of the present invention will be readily apparent from the following more particular description of the exemplary preferred embodiments.

DETAILED DESCRIPTION OF THE PREFERRED EMBODIMENTS

Figure 1:
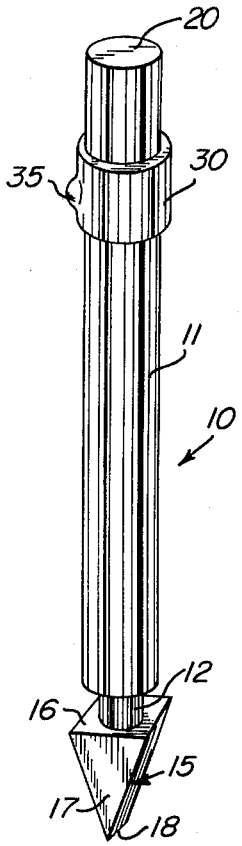
FIG. 1 is a perspective view of one form of preferred embodiment of the present invention.
Figure 2:
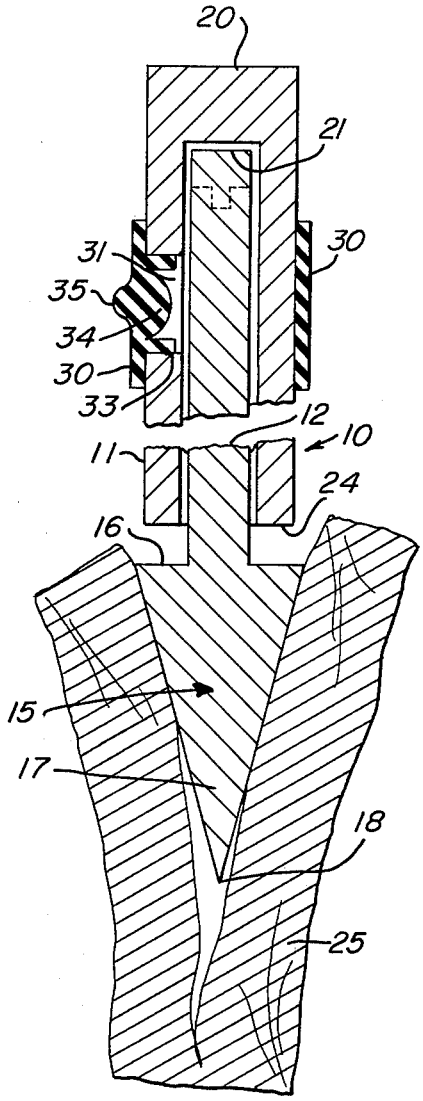
FIG. 2 is a broken and sectioned view of the FIG. 1 embodiment shown as it is entering a log.

An exemplary form of preferred embodiment of a wedging apparatus particularly useful for log splitting is shown in FIGS. 1 and 2. The splitter assembly 10 includes elongated outer member 11 which has a hollow interior for receiving inner member 12. A wedge shaped working head 15 is shown with a base 16 and an outwardly extending but tapered body 17 which terminates in a cutting edge or point 18. Inner member 12 is rigidly attached to head 15 in normal relation to the general plane of base 16 relative to the central axis of member 12. Although member 12 is shown joined integrally with head 15, it will be understood that it can be attached by threads, welding, bonding or any suitable arrangement. The cross-sectional configuration of members 11 and 12 can by cylindrical as illustrated or of any appropriate cross-section as long as they are coaxially reciprocable.

As is best seen in FIG. 2, elongated member 11 has a hollow interior so as to allow coaxial relative movement between members 11 and 12. Outer member 11 has an end cap 20 either formed integrally therewith or otherwise suitably attached. Member 12 is of a greater axial length than outer member 11 as is evident by the gap between base 16 of head 15 and the lower end face 24 of member 11. Thus end cap 20 impacts end 21 of inner member 12 each time member 11 is raised and dropped or rammed downwardly thereby transferring a wedging force to head 15.

Note that cap 20 can be replaceable as by threaded attachment to member 11 thereby permitting increase or decrease of the total weight of member 11 and cap 20 combined. For convenience, the upper portion of inner member 12 including impact surface 21 can be a removable plug threaded, force-fit, welded or otherwise secured into the main body of member 12. This is shown in dashed lines in FIG. 2. This permits replacement of the plug as it deforms or mushrooms from extended use. Further, such a plug can be of a smaller diametric dimension at face 21 than the main body of member 12 to accomodate at least some of this deformation.

The advantage of this invention for extended use in log splitting is best seen in FIG. 2. More particularly, the outer edge of lower face 24 of outer member 11 is dimensioned so as to be equal to or smaller than the wedged opening of log 25 as it is split. Although the outer edges of face 24 are shown slightly narrower than the width of head base 16 in FIG. 2, the width of face 24 can clearly be somewhat larger than base 16 and still not be frictionally impeded from reciprocation by the interior walls of log 25 as it is split. Of course the outer, lower portion of member 11 can be itself tapered to clear the split log walls if desired.

As a consequence, continual raising and lowering of member 11 so as to impact member 12 will not be disrupted by the entire head 15 entering the log to be split. With the prior art wedge and hammer procedure, the entry of the head of the wedge into a position as in FIG. 2 would prevent any further splitting of the log 25 without resort to some additional remedial action such as use of more wedges, crowbars, etc. With the present invention, the wedge head can be continually driven under influence of the coaxially reciprocating motion between members 11 and 12 until head 15 has completely passed through log 25.

Member 11 and 12 can be arranged so as to include means for temporarily interlocking against the coaxial movement to facilitate withdrawal and transporting of the device as a unit. One advantageous arrangement for accomplishing this result is shown in FIGS. 1 and 2 in the form of flexible band 30, which snuggly fits over the outer circumferential surface of member 11. Outer member 11 has a bore 31 into which a ring 33 and inwardly extending bulbous portion 34 are seated when band 30 is in place. The small outwardly extending nub 35 aids the user in locating the proper pressure point when interlocking is desired. The interlocking is established by the user grasping member 11 around band 30 when inner member 12 is positioned with end 21 generally as depicted in FIG. 2. Radially inward pressure on nub 35 causes bulbous portion 34 to deform into bore 31 until it engages the outer surface of member 12. The outside surface of member 12 can be knurled or other suitable procedures taken to increase friction as necessary. At this point, the user can lift the entire device as a unit.

It should be noted that various arrangements can be used to obtain this interlocking result. Band 30 can be a segment of rubber or elastic tube bonded or stretch-fit onto member 11 without grommet insert 33 or bulbous portions 34 and/or 35. Additionally, a plurality of bores similar to hole 31 can be spaced around the upper end of member 11. Still further, the interlocking gripper structure can be on the lower end of member 11 alone or in addition to other gripper structures along the length of 11.

Figure 3:
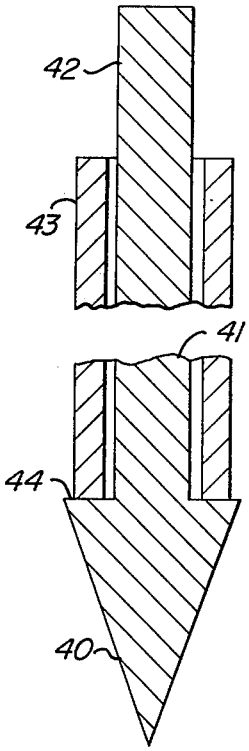
FIG. 3 is a sectioned and broken side view of a variation of the preferred embodiment.
Figure 6:
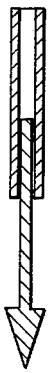
FIG. 6 is a sectioned side view of the FIG. 3 embodiment with the moveable member in a typical raised position immediately prior to its downward movement to impact the wedge head.

In FIGS. 3 and 6, wedge or working head 40 is rigidly attached to inner elongated member 41 in a manner somewhat similar to the FIG. 1 arrangement. However, the outer member 43, which is coaxially moveable over member 41, has no end cap and therefore is allowed to impact the upper surface 44 of head 40. As will be readily apparent to those having normal skill in the art from the foregoing description as well as from a perusal of the drawings (ie: FIGS. 1 and 2 along with FIG. 3), outer member 43 is of a length for accomodating manual reciprocal movement of the upper end thereof substantially beyond the upper end of inner member 41 while maintaining the coaxial relation between members 41 and 43. Additionally, inner member 41 is made of a longer dimension lengthwise than member 43 so that a portion 42 extends above as shown for grasping and transporting of the entire unit without the need for an interlocking device.

Figure 4:
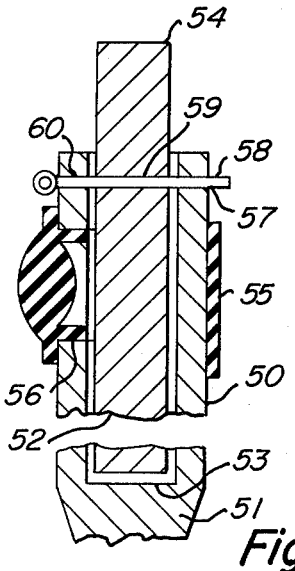
FIG. 4 is a side view in broken section showing additional variations of the preferred embodiment.

FIG. 4 shows an embodiment wherein the outer member 50 is rigidly attached to working head 51. Inner coaxially moveable member 52 impacts the upper inner surface 53 of head 51 and is retractable via upper extension 54. The FIG. 4 embodiment shows a temporary interlocking flexible band 55 deformable into hole 56 in a manner somewhat analogous to the structure described hereinbefore for FIG. 1. Additionally, a pin 58 can be inserted through bores 57, 59 and 60 through members 50 and 52. This pin 58 thereby more permanently interlocks the moveable elements for convenient transport.

Figure 5:
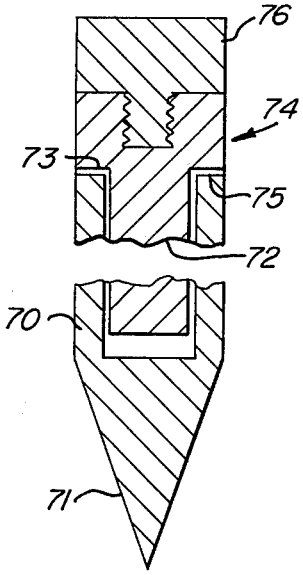
FIG. 5 is a broken and sectioned side view illustrating replaceable end caps and other variations of the preferred embodiment.

FIG. 5 shows an embodiment somewhat similar to FIG. 4 except that outer member 70, which is rigidly attached to work head 71, is longer in length than inner member 72. Thus the driving force for head 71 is developed by the lower flange surface 73 of cap end 74 impacting the upper surface 75 of member 70. FIG. 5 also illustrates a means for varying the weight of the impacting member 72 through replaceable stub 76 shown here as threadedly engaged into member 72.

In a typical practical implementation of the present invention generally in accordance with FIGS. 1 and 2, the inner and outer elements were formed of black iron pipe material with the inner member having an outside diameter of 1.32 inches while the outer member was 0.14 inches thick radially and with an average of about 0.03 inches clearance between the outer surface of the inner member and the inner surface of the outer member. The inner member was 49.0 inches long while the outer member was 47.5 (inside dimension) inches long. The flexible interlocking bands can typically be made from neoprene rubber material.

In use, the present invention can be easily located at the desired point of initial log splitting and the coaxially moveable members reciprocated with relatively high stability and safety not available with conventional wedges and hammers. Further, the device can be economically fabricated. It is handy for transport and use by one person.

Various changes, variations, modifications and applications of the present invention will be readily apparent to those having normal skill in the art without departing from the spirit of the present invention. For example, the interlocking can be accomplished by a threaded lock pin, pivotably releasable spring-biased lock pin or the like. Also, the outer surface of the inner member can be modified to augment the frictional engagement with the temporary interlocking means such as by knurling, indenting and the like.

I claim:

1. Apparatus for performing wedging type operations on severable material as in log splitting or the like comprising:

first and second elongated members, said first member having a hollow interior for receiving said second member within said first member and for accomodating coaxial relative movement between said members, an elongated head having a base and a tapered body extending from said base to a tip, one of said elongated members being rigidly attached to said head base with the central axis of said attached member being generally normal to the plane of said head base, and means selectably operable for securing said first and second elongated members against said coaxial relative movement therebetween, said securing means including a flexible band attached in surrounding relation to the outer surface of said outer member, said first member having at least one radial opening therethrough for allowing said band to be flexed for frictionally engaging the outer surface of said second member.

2. Apparatus in accordance with claim 1 wherein said band includes a thickened portion for normally extending at least partially through said first member opening.

3. Apparatus for performing wedging type operations on a severable material as in log splitting or the like comprising:

first and second elongated members, said first member having a hollow interior for receiving said second member within said first member and for accomodating coaxial relative movement between said members, an elongated head having a base and a tapered body extending from said base to a tip, one end of said second elongated member being rigidly attached to said head base with the central axis of said second member being generally normal to the plane of said head base, said first member having a length less than said second member and one end enclosed by a cap whereby movement of said first member towards said head results in impact of said cap on the end of said second member and in transfer of coaxially directed force to said head, the radial outer extension of the lower end of said first elongated member being dimensioned so as to be equal to or less than the outer dimension of the wedged opening in the material to be split after entry thereinto by said head, the end of said second member opposite said head base attached end including a removable plug.

4. Apparatus for performing wedging type operations on a severable material as in log splitting or the like comprising:

first and second elongated members, said first member having a hollow interior for receiving said second member within said first member and for accomodating coaxial relative movement between said members, an elongated head having a base and a tapered body extending from said base to a tip, one end of said first member being rigidly attached to said head base with the central axis of said attached first member being generally normal to the plane of said head base, said second member having a length greater than said first member, the radial outer extension of the lower end of said first elongated member being dimensioned so as to be equal to or less than the outer dimension of the wedged opening in the material to be split after entry thereinto by said head.

5. Apparatus for performing wedging type operations on a severable material as in log splitting or the like comprising:

first and second elongated members, said first member having a hollow interior for receiving said second member within said first member and for accomodating coaxial relative movement between said members, an elongated head having a base and a tapered body extending from said base to a tip, one end of said first member being rigidly attached to said head base with the central axis of said attached first member being generally normal to the plane of said head base and the other end of said attached first member being in open communication with said first member hollow interior, the radial outer extension of the lower end of said first elongated member being dimensioned so as to be equal to or less than the outer dimension of the wedged opening in the material to be split after entry thereinto by said head, said second member having a length less than said first member and further having a cap on one end for impacting the end of said first member opposite said head base attachment as said second member is moved into said first member.

6. Apparatus for performing wedging type operations on a severable material as in log splitting or the like comprising:

first and second elongated members, said first member having a hollow interior for receiving said second member within said first member and for accomodating coaxial relative movement between said members, and an elongated head having a base and a tapered body extending from said base to a tip, said second member being of a length greater than said first member and having a first end rigidly attached to said head base with the central axis thereof being generally normal to the plane of said head base, the radial outer extension of a first end of said first elongated member being dimensioned so as to equal to or less than the outer dimension of the wedged opening in the material to be split after entry thereinto by said head, said first elongated member being reciprocally moveable over said second elongated member for directly impacting said first end thereof onto said head base, said first member being of a length for manual reciprocal movement of the second end thereof substantially past the second end of said second member while maintaining said coaxial relation between said members, the said longer length of said second member being dimensioned for manual grasping of said second member whenever said first member is in surrounding relation to said second member and is resting on said head base whereby the apparatus can be manually transported as a unit.

* * * * *